US009120493B2

(12) United States Patent
Kumar et al.

(10) Patent No.: US 9,120,493 B2
(45) Date of Patent: Sep. 1, 2015

(54) METHOD AND APPARATUS FOR DETERMINING TRACK FEATURES AND CONTROLLING A RAILROAD TRAIN RESPONSIVE THERETO

(75) Inventors: Ajith Kuttannair Kumar, Erie, PA (US); James D. Brooks, Erie, PA (US)

(73) Assignee: General Electric Company, Schenectady, NY (US)

( * ) Notice: Subject to any disclaimer, the term of this patent is extended or adjusted under 35 U.S.C. 154(b) by 1794 days.

(21) Appl. No.: 11/742,554

(22) Filed: Apr. 30, 2007

(65) Prior Publication Data

US 2008/0269967 A1 Oct. 30, 2008

(51) Int. Cl.

| | |
|---|---|
| ***G05D 3/12*** | (2006.01) |
| ***B61L 3/00*** | (2006.01) |
| ***B61L 27/00*** | (2006.01) |

(52) U.S. Cl.

CPC ..... *B61L 3/006* (2013.01); *B61L 27/0027* (2013.01)

(58) Field of Classification Search

CPC ..... B61L 3/00; B61L 3/002; B61L 3/004; B61L 3/006; B61L 13/008; B61L 3/02; B61L 3/06; B61L 3/065; B61L 3/08; B61L 3/127; B61L 3/16; B61L 3/18; B61L 3/22; B61L 3/221; B61L 3/225; B61L 3/227; B61L 27/00; B61L 27/0005; B61L 27/0011; B61L 27/0016; B61L 27/0022; B61L 27/0027; B61L 27/0038; B61L 27/0061; B61L 27/0077; B61L 27/0083; B61L 27/04

USPC ..... 246/167 R, 169 R, 186; 701/1, 19, 20

See application file for complete search history.

(56) References Cited

U.S. PATENT DOCUMENTS

| | | | | |
|---|---|---|---|---|
| 3,519,805 | A | | 7/1970 | Thorne-Booth |
| 3,650,216 | A | | 3/1972 | Harwick et al. |
| 3,655,962 | A | | 4/1972 | Koch |
| 3,865,042 | A | | 2/1975 | DePaola et al. |
| 4,005,838 | A | | 2/1977 | Grundy |
| 4,041,283 | A | * | 8/1977 | Mosier ..... 701/20 |
| 4,042,810 | A | * | 8/1977 | Mosher ..... 701/19 |
| 4,181,943 | A | | 1/1980 | Mercer, Sr. |
| 4,253,399 | A | | 3/1981 | Spigarelli |
| 4,279,395 | A | | 7/1981 | Boggio et al. |
| 4,337,706 | A | * | 7/1982 | Loosli ..... 105/184 |
| 4,344,364 | A | * | 8/1982 | Nickles et al. ..... 105/62.1 |
| 4,401,035 | A | | 8/1983 | Spigarelli et al. |
| 4,561,057 | A | | 12/1985 | Haley, Jr. et al. |
| 4,602,335 | A | | 7/1986 | Perlmutter |
| 4,711,418 | A | | 12/1987 | Aver, Jr. et al. |
| 4,735,385 | A | | 4/1988 | Nickles et al. |
| 4,794,548 | A | | 12/1988 | Lynch et al. |
| 4,827,438 | A | | 5/1989 | Nickles et al. |
| 4,853,883 | A | | 8/1989 | Nickles et al. |

(Continued)

FOREIGN PATENT DOCUMENTS

| | | |
|---|---|---|
| EP | 1 297 982 | 4/2003 |

*Primary Examiner* — Stephen Holwerda

(74) *Attorney, Agent, or Firm* — GE Global Patent Operation; John A. Kramer

(57) ABSTRACT

A method for determining a control parameter of a railway system vehicle or a portion thereof, the method including producing a terrain profile representing a parameter of the railway system or a portion thereof, producing a representation of the vehicle or a portion thereof, and using the terrain profile and representation to derive the control parameter for the vehicle or the portion thereof.

35 Claims, 4 Drawing Sheets

(56) References Cited

U.S. PATENT DOCUMENTS

| | | | | | |
|---|---|---|---|---|---|
| 5,109,343 | A | | 4/1992 | Budway | |
| 5,239,472 | A | * | 8/1993 | Long et al. | 701/20 |
| 5,398,894 | A | | 3/1995 | Pascoe | |
| 5,437,422 | A | | 8/1995 | Newman | |
| 5,440,489 | A | | 8/1995 | Newman | |
| 5,610,372 | A | * | 3/1997 | Phillips et al. | 177/25.14 |
| 5,676,059 | A | | 10/1997 | Alt | |
| 5,744,707 | A | | 4/1998 | Kull | |
| 5,758,299 | A | | 5/1998 | Sandborg et al. | |
| 5,785,392 | A | | 7/1998 | Hart | |
| 5,787,815 | A | * | 8/1998 | Andersson et al. | 105/199.2 |
| 5,791,063 | A | * | 8/1998 | Kesler et al. | 33/651 |
| 5,828,979 | A | * | 10/1998 | Polivka et al. | 701/117 |
| 5,877,455 | A | * | 3/1999 | Kyrtsos | 177/1 |
| 5,950,967 | A | | 9/1999 | Montgomery | |
| 5,983,144 | A | * | 11/1999 | Bonissone et al. | 701/19 |
| 5,995,737 | A | * | 11/1999 | Bonissone et al. | 703/8 |
| 6,112,142 | A | | 8/2000 | Shockley et al. | |
| 6,125,311 | A | | 9/2000 | Lo | |
| 6,144,901 | A | * | 11/2000 | Nickles et al. | 701/19 |
| 6,167,357 | A | * | 12/2000 | Zhu et al. | 702/175 |
| 6,269,034 | B1 | | 7/2001 | Shibuya | |
| 6,308,117 | B1 | | 10/2001 | Ryland et al. | |
| 6,434,452 | B1 | * | 8/2002 | Gray | 701/19 |
| 6,487,488 | B1 | | 11/2002 | Peterson, Jr. et al. | |
| 6,505,103 | B1 | | 1/2003 | Howell et al. | |
| 6,516,727 | B2 | | 2/2003 | Kraft | |
| 6,591,758 | B2 | | 7/2003 | Kumar | |
| 6,609,049 | B1 | | 8/2003 | Kane et al. | |
| 6,612,245 | B2 | | 9/2003 | Kumar et al. | |
| 6,612,246 | B2 | | 9/2003 | Kumar | |
| 6,615,118 | B2 | | 9/2003 | Kumar | |
| 6,691,957 | B2 | | 2/2004 | Hess, Jr. et al. | |
| 6,694,231 | B1 | | 2/2004 | Rezk | |
| 6,732,023 | B2 | | 5/2004 | Sugita et al. | |
| 6,763,291 | B1 | | 7/2004 | Houpt et al. | |
| 6,789,005 | B2 | | 9/2004 | Hawthorne | |
| 6,810,312 | B2 | | 10/2004 | Jammu et al. | |
| 6,824,110 | B2 | | 11/2004 | Kane et al. | |
| 6,845,953 | B2 | | 1/2005 | Kane et al. | |
| 6,853,888 | B2 | | 2/2005 | Kane et al. | |
| 6,856,865 | B2 | | 2/2005 | Hawthorne | |
| 6,863,246 | B2 | | 3/2005 | Kane et al. | |
| 6,865,454 | B2 | | 3/2005 | Kane et al. | |
| 6,903,658 | B2 | | 6/2005 | Kane et al. | |
| 6,915,191 | B2 | | 7/2005 | Kane et al. | |
| 6,922,619 | B2 | | 7/2005 | Baig et al. | |
| 6,957,131 | B2 | | 10/2005 | Kane et al. | |
| 6,978,195 | B2 | | 12/2005 | Kane et al. | |
| 6,980,894 | B1 | | 12/2005 | Gordon et al. | |
| 6,996,461 | B2 | | 2/2006 | Kane et al. | |
| 7,021,588 | B2 | | 4/2006 | Hess, Jr. et al. | |
| 7,021,589 | B2 | | 4/2006 | Hess, Jr. et al. | |
| 7,024,289 | B2 | | 4/2006 | Kane et al. | |
| 7,036,774 | B2 | | 5/2006 | Kane et al. | |
| 7,079,926 | B2 | | 7/2006 | Kane et al. | |
| 7,092,800 | B2 | | 8/2006 | Kane et al. | |
| 7,092,801 | B2 | | 8/2006 | Kane et al. | |
| 2002/0059075 | A1 | | 5/2002 | Schick et al. | |
| 2002/0077733 | A1 | * | 6/2002 | Bidaud | 701/19 |
| 2002/0096081 | A1 | | 7/2002 | Kraft | |
| 2003/0105561 | A1 | * | 6/2003 | Nickles et al. | 701/19 |
| 2003/0213875 | A1 | | 11/2003 | Hess, Jr. et al. | |
| 2004/0133315 | A1 | | 7/2004 | Kumar et al. | |
| 2004/0238693 | A1 | * | 12/2004 | Cole | 246/3 |
| 2004/0245410 | A1 | | 12/2004 | Kisak et al. | |
| 2005/0065674 | A1 | | 3/2005 | Houpt et al. | |
| 2005/0120904 | A1 | | 6/2005 | Kumar et al. | |
| 2006/0108872 | A1 | * | 5/2006 | Marra et al. | 307/10.1 |
| 2007/0219680 | A1 | | 9/2007 | Kumar et al. | |

* cited by examiner

METHOD AND APPARATUS FOR DETERMINING TRACK FEATURES AND CONTROLLING A RAILROAD TRAIN RESPONSIVE THERETO

FIELD OF THE INVENTION

Embodiments of the present invention relate to railroad train operations and more particularly to determining track features that affect train handling and controlling the train responsive to determined track features to limit in-train forces, thereby reducing the likelihood of train and railcar damage.

BACKGROUND OF THE INVENTION

A locomotive is a complex system with numerous subsystems, each subsystem interdependent on other subsystems. An operator aboard a locomotive applies tractive and braking effort (including the application of dynamic brakes and independent brakes at the locomotive and air brakes at the railcars of the train) to control the speed of the locomotive and its load of railcars to assure proper operation and timely arrival at the desired destination. Speed/power control must also be exercised to maintain in-train forces within acceptable limits, thereby avoiding excessive coupler forces and the possibility of a train break. To perform this function and comply with prescribed operating speeds that may vary with the train's location on the track, the operator generally must have extensive experience operating the locomotive over the specified terrain with different railcar consists.

Train control can also be performed by an automatic train control system that determines train and trip parameters, e.g., train mass, train location, and applies tractive effort and braking effort to safely and efficiently control the train. Alternatively, a train control system can advise the operator of preferred train control actions, with the operator manually exercising train control in accordance with the advised actions and in further accordance with his/her independent train control assessments.

BRIEF DESCRIPTION

A method for determining a control parameter of a railway system vehicle or a portion thereof is disclosed. The method including producing a terrain profile representing a parameter of the railway system or a portion thereof. Another step involves producing a representation of the vehicle or a portion thereof. The terrain profile and representation are used to derive the control parameter for the vehicle or the portion thereof.

A method of operating a railway system vehicle or a portion thereof is also disclosed. This method includes generating a terrain profile representing a parameter of the railway system vehicle or a portion thereof. Another step includes generating a representation of the vehicle or a portion thereof. The terrain profile and the representation are combined to provide an indication of handling characteristics of the railway system vehicle or a portion thereof.

In another embodiment, a method for determining handling characteristics of a railway system vehicle traversing a track segment is disclosed. The method includes a step for producing a profile representing a parameter of the track segment. A step for producing a modified profile according to a vehicle characteristic is also included. A third step involves comparing the modified profile and the parameter of the track segment to provide an indication of the vehicle handling characteristics.

In yet another embodiment, a computer program product for determining a control parameter of a railway system vehicle or a portion thereof is disclosed. The computer program product has a computer usable medium having computer readable program code modules embodied in the medium for producing a terrain profile representing a parameter of the railway system or a portion thereof. A computer usable medium having computer readable program code modules embodied in the medium is also provided for producing a representation of the vehicle or a portion thereof. A computer usable medium having computer readable program code modules embodied in the medium is further disclosed for using the terrain profile and representation to derive the control parameter for the vehicle or the portion thereof.

A computer program product for operating a railway system vehicle or a portion thereof is further disclosed. The computer program product includes a computer usable medium having computer readable program code modules embodied in the medium for generating a terrain profile representing a parameter of the railway system vehicle or a portion thereof. A computer usable medium having computer readable program code modules embodied in the medium is disclosed for generating a representation of the vehicle or a portion thereof. A computer usable medium having computer readable program code modules embodied in the medium is also disclosed for combining the terrain profile and the representation to provide an indication of handling characteristics of the railway system vehicle or a portion thereof.

A computer program product for determining handling characteristics of a railway system vehicle traversing a track segment is further disclosed. The computer program product includes a computer usable medium having computer readable program code modules embodied in the medium for producing a profile representing a parameter of the track segment, and a computer usable medium having computer readable program code modules embodied in the medium for producing a modified profile according to a vehicle characteristic. Further disclosed is a computer usable medium having computer readable program code modules embodied in the medium for comparing the modified profile and the parameter of the track segment to provide an indication of the vehicle handling characteristics.

An apparatus for determining a control parameter of a railway system vehicle or a portion thereof is disclosed. The apparatus includes a first element configured to produce a terrain profile that represents a parameter of the railway system or a portion thereof. A second element is disclosed as being configured to produce a representation of the vehicle or a portion thereof. A third element is further disclosed which is configured to use the terrain profile and representation to derive the control parameter for the vehicle or the portion thereof.

BRIEF DESCRIPTION OF THE DRAWINGS

A more particular description of the invention embodiments will be rendered by reference to specific embodiments thereof that are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION

Figure 1:
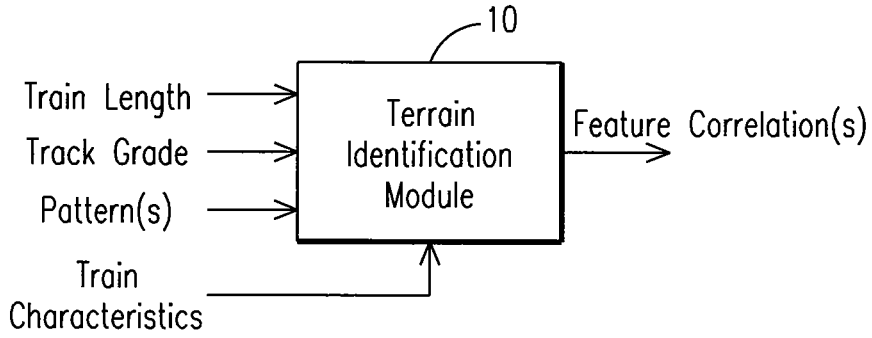
FIG. 1 illustrates a terrain identification module according to the teachings of the present invention.

Reference will now be made in detail to the embodiments consistent with aspects of the invention, examples of which are illustrated in the accompanying drawings. Wherever possible, the same reference numerals used throughout the drawings refer to the same or like parts.

Embodiments of the present invention overcome certain disadvantages in the art by providing a system, method, and computer implemented method for identifying significant terrain features and controlling a railway system responsive to the feature, including in various applications, a locomotive consist, a locomotive consist and a plurality of railcars and a maintenance-of-way vehicle. The embodiments are also applicable to a train including a plurality of distributed locomotive consists, referred to as a distributed power (DP) train, typically including a lead consist and one or more non-lead (remote) consists.

Persons skilled in the art will recognize that an apparatus, such as a data processing system, including a CPU, memory, I/O, program storage, a connecting bus, and other appropriate components, could be programmed or otherwise designed to facilitate practicing the method embodiments of the invention. Such a system would include appropriate programming or software commands for executing the method embodiments.

In another embodiment, an article of manufacture, such as a pre-recorded disk or other similar computer program product, for use with a data processing system, includes a storage medium and a program recorded thereon for directing the data processing system to facilitate the practice of the invention embodiments. Such apparatus and articles of manufacture also fall within the spirit and scope of the invention embodiments.

The disclosed invention embodiments teach methods, apparatuses, and programs for determining track features and controlling a railway system responsive thereto. To facilitate an understanding of the embodiments of the present invention they are described hereinafter with reference to specific implementations thereof.

According to one embodiment, the invention is described in the general context of computer-executable instructions, such as program modules, executed by a microprocessor or a computer. Generally, program modules include routines, programs, objects, components, data structures, etc. that perform particular tasks or implement particular abstract data types. For example, the software programs that underlie the embodiments of the invention can be coded in different languages, for use with different processing platforms. It will be appreciated, however, that the principles that underlie the invention embodiments can be implemented with other types of computer software technologies as well.

Moreover, those skilled in the art will appreciate that the embodiments of the invention may be practiced with other computer system configurations, including hand-held devices, multiprocessor systems, microprocessor-based or programmable consumer electronics, minicomputers, mainframe computers and the like. The embodiments of the invention may also be practiced in a distributed computing environment where tasks are performed by remote processing devices that are linked through a communications network. In the distributed computing environment, program modules may be located in both local and remote computer storage media including memory storage devices. These local and remote computing environments may be contained entirely within the locomotive, within other locomotives of the train, within associated railcars, or off-board in wayside or central offices where wireless communications are provided between the different computing environments.

The term "locomotive" can include (1) one locomotive or (2) multiple locomotives in succession (referred to as a locomotive consist), connected together so as to provide motoring and/or braking capability with no railcars between the locomotives. A train may comprise one or more such locomotive consists. Specifically, there may be a lead consist and one or more remote (or non-lead) consists, such as a first non-lead (remote) consist midway along the line of railcars and another remote consist at an end-of-train position. Each locomotive consist may have a first or lead locomotive and one or more trailing locomotives. Though a consist is usually considered connected successive locomotives, those skilled in the art recognize that a group of locomotives may also be consider a consist even with at least one railcar separating the locomotives, such as when the consist is configured for distributed power operation, wherein throttle and braking commands are relayed from the lead locomotive to the remote trails over a radio link or a physical cable. Towards this end, the term locomotive consist should be not be considered a limiting factor when discussing multiple locomotives within the same train.

The various embodiments of the invention as described herein can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the invention are discussed below.

Two adjacent railroad railcars or locomotives are linked by a knuckle coupler attached to each railcar or locomotive. Generally the knuckle coupler includes four elements, a cast steel coupler head, a hinged jaw or "knuckle" rotatable relative to the head, a hinge pin about which the knuckle rotates during the coupling or uncoupling process and a locking pin. When the locking pin on either or both couplers is moved upwardly away from the coupler head the locked knuckle rotates into an open or released position, effectively uncoupling the two railcars/locomotives. Application of a separating force to either or both of the railcars/locomotives completes the uncoupling process.

When coupling two railcars, at least one of the knuckles must be in an open position to receive the jaw or knuckle of the other railcar. The two railcars are moved toward each other. When the couplers mate the jaw of the open coupler closes and responsive thereto the gravity-fed locking pin automatically drops in place to lock the jaw in the closed condition, locking the couplers closed to link the two railcars.

Even when coupled and locked, the distance between the two linked railcars can increase or decrease due to the spring-like effect of the interaction of the two couplers and due to the open space between the mated jaws or knuckles. The distance by which the couplers can move apart when coupled is referred to as an elongation distance or coupler slack and can be as much as about four to six inches per coupler. A stretched slack condition occurs when the distance between two coupled railcars is about the maximum separation distance permitted by the slack of the two linked couplers. A bunched (compressed) condition occurs when the distance between two adjacent railcars is about the minimum separation distance as permitted by the slack between the two linked couplers.

The distance decreases responsive to coupler bunching forces (e.g., the application of braking effort (BE)) that drive the jaw of each coupler into the head of the mating coupler; excessive bunching forces can damage the coupler, the draft gear and the railcars. In a completely bunched (compressed) coupler condition the distance between two adjacent railcars is at a minimum. The coupler is connected to a railcar frame through a draft gear that provides a force-absorbing function to cushion the effect of the bunching (and stretching) forces. The train is experience run-in as the couplers are moving toward the bunched state.

Stretching forces reduce the coupler gap by bringing the jaws into contact; excessive stretching forces can damage the coupler, the draft gear and the railcars. In a stretched slack condition the distance between two coupled railcars is at a maximum. The train is experiencing run-out as the couplers are moving the stretched state.

Both the bunching forces and the stretching forces are caused by the application of tractive effort and braking effort by the locomotive and by track features (such as track crests, sags, curves and super-elevations). These forces are also influenced by various train/railcar/track characteristics, e.g., railcar mass, mass distribution along the train, train length, crest height and sag depth.

Changes in the train's slack condition caused by train characteristics, terrain features and tractive/braking effort applications, and the attendant train handling risks, can be predicted or determined according to various techniques described and claimed in the commonly-owned patent application entitled Method and Apparatus for Limiting In-Train Forces of a Railroad Train, filed on Apr. 30, 2007 and assigned application Ser. No. 11/742,568. Slack condition changes and/or other train handling considerations caused by terrain features, including crests, sags, curves and super-elevation, and their effects on a train of interest (i.e., train handling risks), are determined, predicted or inferred according to the teachings of the present invention. With knowledge of the terrain conditions, the train operator (either a human operator or an automatic train control system) can control the train to limit in-train forces to safe values.

A crest is a terrain feature where the grade changes rapidly, relative to characteristics of the train (e.g., the train length, weight distribution, consist characteristics), from positive to negative. Conversely, at a sag the grade changes rapidly from negative to positive, again relative to the characteristics of the train (e.g., the train length, weight distribution, consist characteristics). Track curves also present a risk in high tractive effort situations (i.e., at low train speeds). These latter risks are referred to as stringlining in the tension case or buckling/jackknifing in the compression case.

Although the methodology of the embodiments of the present invention is described primarily in the context of identifying crests and sags and their effect on a train of interest, the techniques can be used to identify any terrain feature, especially terrain features that will have a significant effect on train handling, such as curvature, small grades, super-elevation, speed limits, etc.

High in-train forces, which can create train-handling risks, are generated as the locomotive and the railcars cross the crest apex. As the train approaches the crest it is in a stretched coupler condition. The largest coupler forces are experienced by the railcar crossing the apex. As each railcar behind the lead locomotive crosses the apex, it is subjected to a gravitational force having a component in the same direction as the tractive effort applied by the lead locomotive (or by the lead locomotive consist or the lead and non-lead locomotive consist in a distributed power train). Each railcar (specifically each railcar coupler) on the downward crest slope experiences a force equal to the tractive effort plus the sum of the gravitational forces exerted on each railcar from the railcar of interest to the forward end of the train. The rail cars on the upward slope approaching the crest exert a stretching force on the railcars on the downward slope. Thus the total magnitude of the force exerted on each railcar increases as another railcar crosses the apex until half of the train mass is on the descending side of the crest.

As the train is crossing the crest, the magnitude of the force at different locations along the train depends on the number of railcars in the train, the weight and resistance of each railcar, the track grade on the upward and downward slopes of the crest, the position of each railcar relative to the apex and other operating parameters and train characteristics. Thus at certain locations in the train or at certain times as the train crosses the crest, the coupler forces may exceed coupler force limits.

Typically, the operator reduces train power as the lead locomotive crests the hill and does not accelerate (apply additional tractive effort) until about half the train has crossed the apex. This driving strategy ensures that the train speed does not increase by more than a predetermined amount as it traverses the crest. The amount of power reduction necessary is a function of train characteristics, terrain characteristics and operating parameters, including, but not limited to, crest severity, locomotive consist, train makeup and current speed. This operating technique limits the peak coupler forces at the apex of the crest.

The train handling risk at a track sag, which can also be predicted or identified according to the embodiments of the present invention, is due to the rapid slack state transition caused by the sag. With the entire train on the downhill approach to the bottom of the sag, the train begins to accelerate uniformly responsive to the average grade over the length of the train and the tractive effort of the locomotive consist(s). Under power, the train is normally stretched as it approaches the sag. As the lead locomotive crosses the sag trough and begins to ascend the uphill side of the sag it begins to decelerate. Meanwhile, the rear of the train is still accelerating on the downhill side of the sag. It can be seen that a rapid change from a stretched to a bunched condition occurs at the bottom or trough of the track sag.

Track curves can also present train handling challenges. When the train navigates a high curvature track feature, large coupler angles, which are a function of the railcar lengths and the radius of curvature, are created between adjacent railcars. Because of these coupler angles, large lateral forces are exerted on the linked railcars. If these lateral forces become substantially large relative to the vertical forces (due to the railcar weight), the rail cars may derail.

According to the prior art, the operator's control (application of tractive and braking efforts) of the train when crests, sags, curves, etc. are encountered is based primarily on his experiences operating similar trains over similar track terrains. His knowledge (to a limited quantitative extent) of the train characteristics (length, mass, mass distribution, etc.) and terrain characteristics (grade, curvature, superelevation, etc.) also informs his control actions.

To alleviate the train handling effects of these terrain features, the system of one embodiment of the present invention detects the occurrence of a crest or a sag and determines the effect of the crest or sag on the train based on train characteristics (e.g., weight, weight distribution, length) and operating parameters (e.g., speed, acceleration). Once these effects are known, the operator (either a human operator, an automatic train control system, or an advisory train control system) can adjust train operation to avoid high in-train forces that can damage the couplers or railcars or cause a derailment. The processes of the embodiments of the present invention provide a better assessment of potential train handling problems and therefore permit better train control than can be provided by an operator based on his experiences.

It should be noted that although the track profile is typically mapped for a rail network and this information is therefore available to the train operator, the significance (from a train handling perspective) of a specific crest or sag on the network is substantially influenced by specific train characteristics. Thus the present invention is advantageous in determining the effects of crests and sags and developing control strategies that limit in-train forces for specific trains. Although an experienced train operator familiar with the track segment the train is traversing will generally be aware of the effect of crests and sags on train operation, he is typically not capable of determining the significance of the crest or sag on a specific train, because these effects depend on train characteristics that he will not know in detail, such as the grade with respect to weight distribution or the degree of curvature with respect to the train length.

The effects of different track features on different trains (and different train segments) are based on the train characteristics (such as length, total weight and weight distribution) and train operation parameters such as speed and acceleration and the profile of the crest or sag. For a long train, macro-level risks of sags and crests may be less significant as the train may be draped over several terrain features (e.g., crests and sags) simultaneously, leading to localized effects that may cancel each other. Conversely, for a relatively short train, closely spaced track grade changes are needed before the front and back train segments experience significantly different grade conditions. Such closely-spaced crests or sags are therefore significant for a relatively short train.

FIG. 1 illustrates a terrain identification module 10 responsive to exemplary input parameters comprising train length, other train characteristics (as disclosed herein), track grade and exemplary profile patterns of interest (e.g., crest, sag, curve, super-elevation patterns). An output feature correlation parameter indicates the effect of the crest, sag, curve, or super-elevation (or other track feature) on the train (or segments of the train) presenting the supplied input parameters.

The terrain identification module 10 of one embodiment of the present invention is implemented by comparing an actual track grade profile to an exemplary crest, sag, curve or super-elevation patterns supplied to the module. The patterns may be selected based on the particular terrain features of interest. The integration is performed over the train length for a range of track location values that the train is expected to traverse. Thus the resulting correlation value, which indicates a presence and steepness of the crest slope (i.e., severity) relative to the selected crest pattern and current train parameters is a function of x. If the correlation value is near zero at track location x, that indicates that a particular feature does not exist for that particular train at location x. The higher the correlation, the higher the respective slopes, leading to a more severe crest. As further described below, train handling actions such as the application of tractive effort (TE) or braking effort (BE), are initiated responsive to the correlation value and train-specific characteristics.

Since a train will encounter different terrain features during its trip, different patterns are selected, resulting in a correlation value for each track location x from the beginning to the end of the trip for each feature pattern of interest. The cross-correlation integral is described by the following equation.

$$Correlation_i(x) = \int_{-\text{train_length}}^{\text{train_length}} pattern_i(\tau) \cdot \text{track_grade}(x + \delta + \tau) d\tau$$

The subscript i represents the pattern/feature that has been selected for correlation based on the track terrain feature of interest. At any time multiple features can be detected by evaluating this integral for each pattern feature. Each correlation value then corresponds to the feature associated with the ith pattern.

Furthermore, one embodiment of the invention includes a look ahead factor, δ, in the integral. This parameter allows the correlation of upcoming features.

This correlation calculation can be performed in advance of the train trip and stored onboard for use by the operator (including an automatic train control system operator) in operating the train to limit in-train forces as it traverses the terrain feature. Alternatively, the correlation calculation is performed and attendant train handling problems identified during the train trip prior to the train reaching a terrain feature of interest using the abovementioned parameter δ. When the correlation values and the location of the peak/trough determined in advance, the train can be controlled to limit in-train forces as the crest/sag peak/trough is traversed.

The detection of a terrain feature, e.g., crest, sag or curve, and its significance for train handling can be displayed to the operator for use in operating the train or for use in monitoring operation of the automatic train control system. The display could also include enumeration of the feature (i.e., CREST, SAG, etc.), location of the feature (in 1 mi, etc.), and some enumerated severity (i.e., HIGH, MED, LOW) in addition to the continuous severity (correlation value). Such a human-machine interface (HMI) can also provide the operator with a capability to override the automatic train control system. In another embodiment the HMI comprises an operator input feature that allows the operator to enter terrain feature information that was not detected by the terrain identification system (for example, as a result of erroneous data supplied to the terrain identification system). In yet another embodiment, the operator can correct system terrain information based on his experiences with the track terrain. The HMI also permits the operator to enter train make-up information, such as weigh, available motive power, etc.

Figure 2:
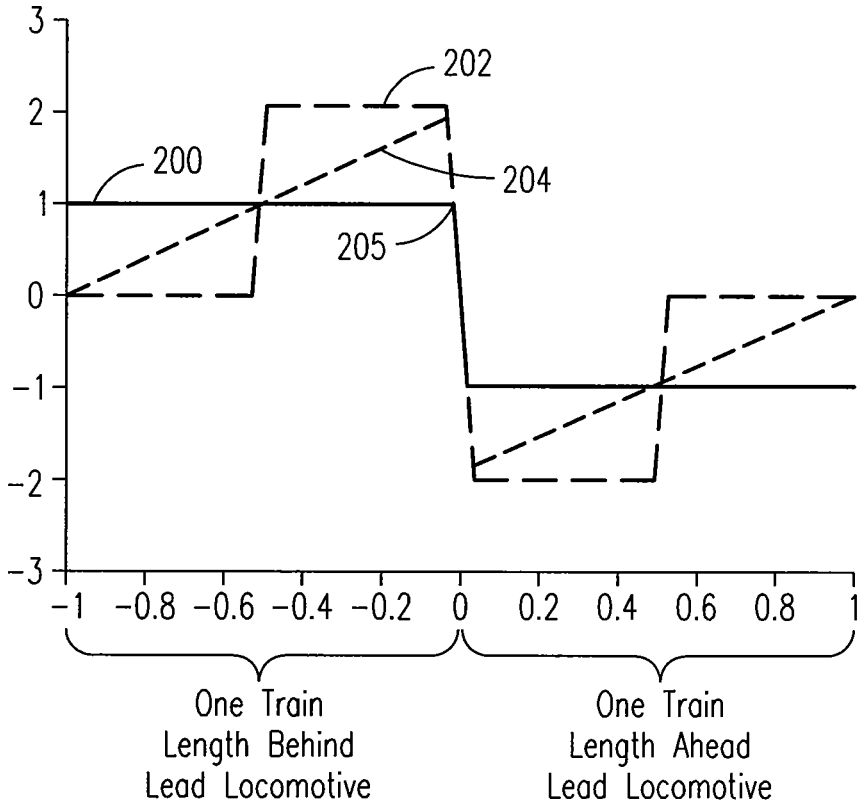
FIGS. 2-8 illustrate various features and process of the terrain identification of the preset invention in graphical form.

FIG. 2 illustrates potential terrain pattern candidates 200, 202 and 204 for crest and sag determination according to the teachings of the embodiments of the present invention. In this plot, zero on the x axis is the current location of the lead locomotive of the train, with the interval 0 to −1 indicating one train length behind the lead locomotive and the interval 0 to +1 indicating one train length in front of the lead locomotive. Thus the train length is normalized to the value 1. The y-axis units are grade percent for a crest or sag feature.

For example, assume a pattern 200 is selected for correlation with an actual track profile to determine the correlation value according to the correlation process described above. Assume the actual track profile comprises a constant +y % grade for one train length approaching the peak followed by a constant −y % grade for one train length beyond the peak. The correlation value according to the equation above will increase linearly from 0 to y on the interval −1 (entire train length rearward of the peak) to 0 as the train approaches the peak. The correlation is maximum when the lead locomotive reaches a point 205 at the origin of the FIG. 2 plot (where the grades changes abruptly). The correlation declines linearly as the locomotive travels away from the point 205, reaching a 0 correlation value after the last train railcar has passed the crest 1 train length later. Thus the magnitude of the correlation at any point x on the x-axis indicates specific crest features with respect to the selected pattern 200. In a more common terrain profile where the grade is not constant (uniform) throughout the length of the train, the correlation magnitude changes non-linearly as a function of x.

Correlation values that indicate potential train handling problems or excessive in-train forces are determined as disclosed herein and supplied to the train controller (manual, automatic or advisory). The thresholds are a function of the particular pattern and feature properties and how the train will interact with respect to this information. For example, a crest will need to be very severe before it will adversely affect a light train with high-yield couplers. Feature correlation values produced by the module 10 in excess of the threshold indicate that significant train handling effects may be encountered as the train traverses the terrain. With this knowledge, the operator can appropriately control the train to avoid the potentially damaging forces that may develop.

The correlation threshold values referred to herein and illustrated in the various figures are set forth as a single value. Alternatively, the threshold values can be a function of train type, train characteristics such as coupler types or other train/track parameters. Moreover, symmetric thresholds (with respect to crests and sags) are not required.

In a terrain profile where the grade is not uniform throughout the length of the train, the magnitude of the correlation, as it changes as a function of x, can be used to determine an equivalent grade change over the next train length. This transformation to the equivalent grade depends on the pattern selected.

Another embodiment employs a continuous scale of numerical values (e.g., degrees) indicating how the changing correlation value is related to the threshold, this scale indicates how the train handling is being affected by the terrain. A positive correlation trending higher may indicate potential train handling problems at a forward track location and a negative correlation trending lower may also indicate train handling problems at a forward track location.

A pattern sag is the inverse of a pattern crest. Thus, while train handling problems during a crest are identified by a high positive correlation value, train handling problems due to sags are identified by a high negative correlation value. Thus, the operator must also consider train handling issues when the correlation is less than a predetermined negative value, indicting a sag that may cause train handling problems.

Different methods can be used to determine the beginning of a significant crest (with respect to the train of interest). For real time correlations (without a look ahead factor as set forth in the correlation equation above), examples include: (1) a minimum correlation magnitude, (2) a minimum correlation magnitude followed by a negative grade, where the value may begin to decrease, (3) a minimum correlation magnitude followed by a sign change in the correlation slope, (4) a minimum correlation magnitude followed by a decline in the correlation value by at least a specified amount.

Figure 6:
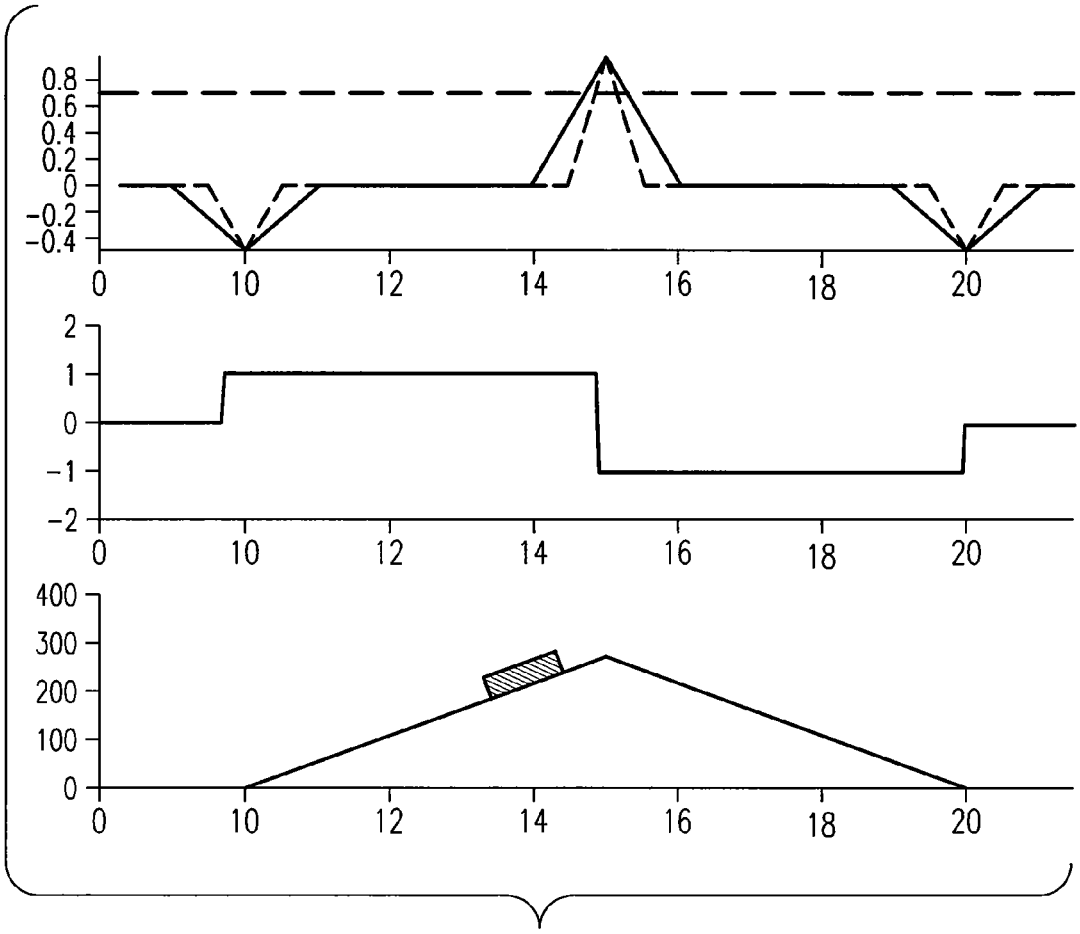

If the correlation operation is performed and the correlation value determined for at least one train length ahead of the train's current position, using the look ahead feature as described above, other criterion can be used to identify the location of the correlation peak. This look ahead feature avoids errors due to track irregularity and the true local maxima (or minima) can be determined more accurately and thus the true crest or sag point determined more accurately. A beginning of a significant sag event can be similarly determined. FIG. 6 depicts this crest detection example.

Other candidate terrain patterns can be constructed having various lengths (e.g., as a percent of train length or a numerically specified length) and shapes. The most appropriate pattern for use in the integration is selected based on the feature sought to be identified. A pattern is selected for each feature. Elements 200-204 are just examples of possible patterns for the crest/sag feature. Additionally, no restriction exists for limiting the use to just one pattern. For example, in the crest/sag case, all three patterns may be used and a selection may be based on the max/min/median correlation value at each point in time as the controlling correlation. Alternatively, an average of the three patterns may be utilized.

The teachings of the invention embodiments can be applied to and the effects of terrain variations determined for the entire train, individual railcars, groups of railcars, arbitrary or uniform train segments. A train segment may include any subsection of the train, including arbitrary segments, uniform segments and individual railcars. Train and individual railcar characteristics, such as train length, railcar length, railcar weight, weight distribution, etc. are supplied to the terrain identification module 10 to determine the effect of the terrain variations on train performance and handling for these segments. To determine the effects on train segments, the correlation integral from the equation above is integrated over only the train segment of interest.

If the train is not uniformly loaded, the point at which a terrain feature becomes notable from a train handling perspective may either shift in time (equivalent to a shift in the train's location as the train traverses the feature) and/or the significance of the feature may change with time/position, such as but not limited to modifying the patterns as discussed in more detail below.

In one embodiment, a curve representing a percentage deviation of train segments (or individual railcars) from an average segment weight (or average of the individual railcar weights) is multiplied by a selected terrain pattern.

Figure 3:
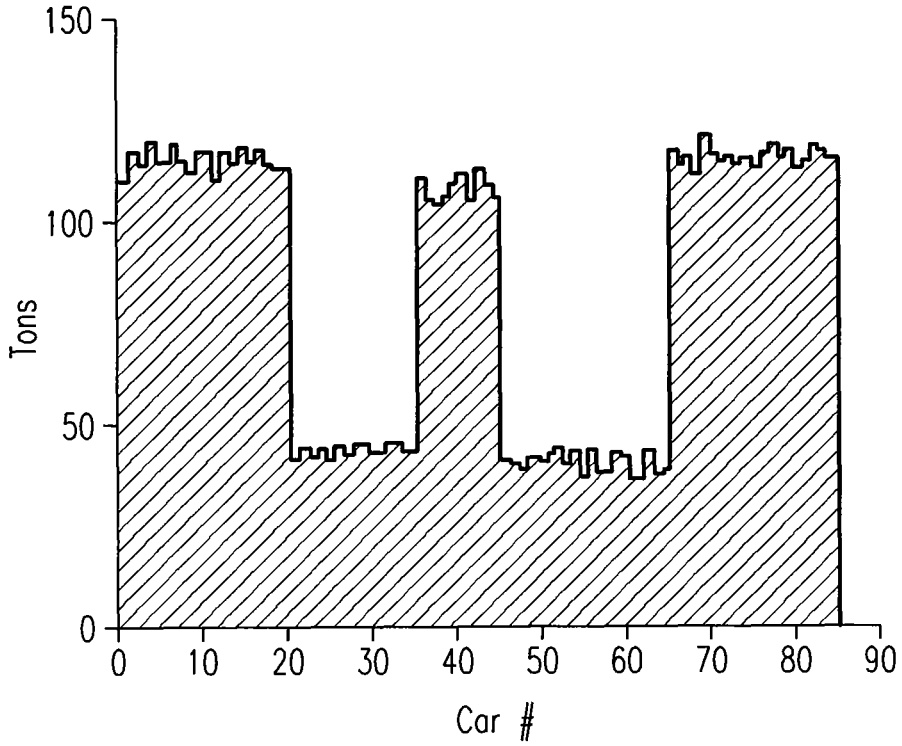

FIG. 3 is a plot depicting the weight of each railcar in an exemplary train. As can be seen, the most forward railcars (where railcar 0 is at the head end of the train), several rear railcars and several mid-train railcars are more than about 60 tons heavier than the other railcars. A corresponding train weight distribution, according to the railcar number, is depicted in FIG. 4, which is a normalized plot of the ratio of the weight of each railcar to the average railcar weight, where a normalized railcar weight equal to the average is indicated by a numeral 1 on the y-axis.

Figure 4:
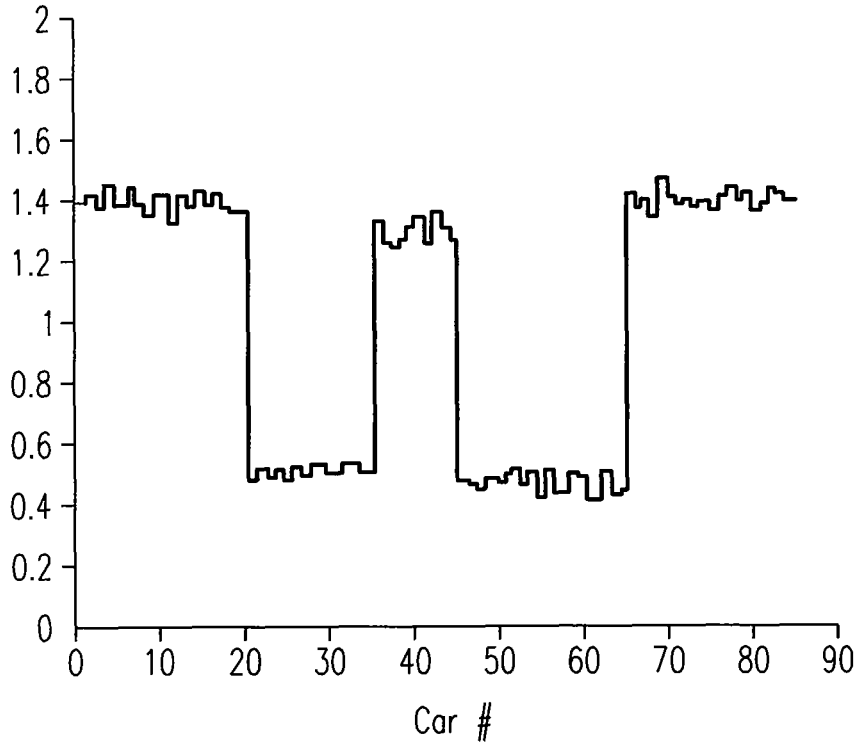
Figure 5:
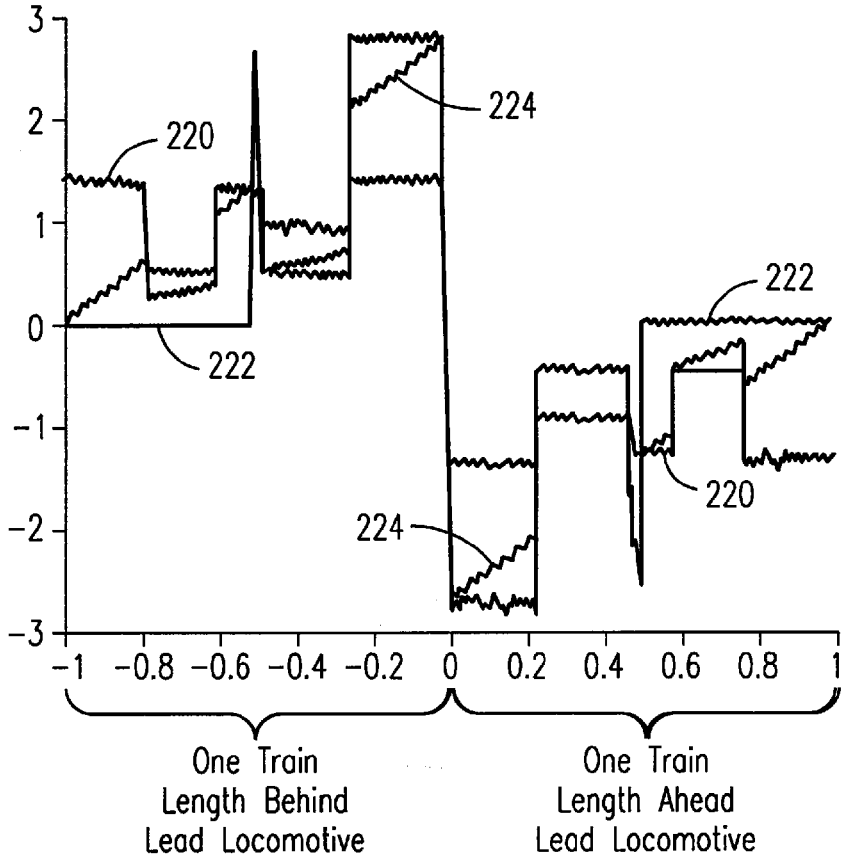

Multiplication of each pattern 200, 202 and 204 of FIG. 2 by the weight distribution function plot of FIG. 4 yields respective weighted patterns in plots 220, 222 and 224 of FIG. 5. These new patterns are used in the correlation method explained above. Thus, this technique associates the train's weight distribution with the candidate patterns to take account of the weight distribution in determining the significance of a terrain feature.

Other embodiments of the invention use different train characteristics to generate the function shown in of Figures and 4. For example, in another embodiment, the weight distribution function plot of FIGS. 3 and 4 is replaced with a ratio of the weight of a unit length of the train (for example one foot of train length, i.e. load density) to the total train weight where the weight is assumed uniformly distributed over the train length. Other train characteristics that can be used include coupler types and train type (unit, manifest, intermodal, etc.).

In still another embodiment, an effective grade technique is used to determine how the train responds to terrain features.

Figure 7:
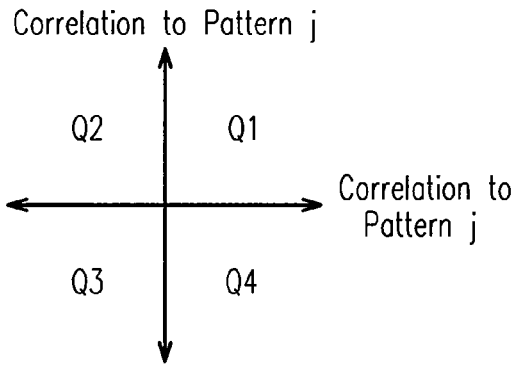

The actual track grade (profile) is converted to an effective (e.g., average) grade over the length of a train. The averaging is performed by assuming uniform weight distribution; in another embodiment a non-uniform weight distribution can be used. In either case, the effective grade is correlated with a different set of track profile patterns. Two exemplary patterns are shown in FIG. 7, where the lead locomotive position at the head end of the train is identified by the numeral 0 on the x axis. The y-axis indicates the effective percent grade. A time lag represented by the offset x-axis interval is due to the lag introduced by the averaging function. If the train weight distribution is not accounted for in the effective grade calculation, it can, as above, be incorporated into the terrain patterns as described in conjunction with FIGS. 3-5.

The terrain identification process executed by the terrain identification module 10 can be performed for the entire trip before the trip begins, in real-time during the trip or in a real-time look ahead fashion. If the terrain identification algorithm is run prior to departure, the resulting feature correlation values (including crest and sag indicators (flags or numerical displays) can be stored in an onboard or off board data base for later use by the train operator. For a railroad train operated by an automatic control system, the feature correlations can be supplied to a train control optimization algorithm for use in controlling the train.

Once a significant crest or sag (or curvature, super-elevation, etc.) is determined from the correlation result, the automatic train control system or the manual operator can exercise better train control to obviate the effects of the crests and sags. If an automatic train control system is not present, the results of the correlation/threshold process can notify the operator of the particular feature the train will soon, or is currently encountering, and suggest a handling strategy (increase notch, hold notch, decrease notch, desired acceleration/speed, etc.) to avoid train handling problems.

For example, when a significant crest is encountered, the lead locomotive power is reduced as the lead locomotive crests the hill such that the train speed increase is limited to a predetermined value until at least half of the train has passed over the crest. The speed increase limit is a function of crest severity (represented by the correlation value), locomotive consist, train makeup and current train speed. According to this technique, the peak coupler forces at the apex of the crest are thus limited below a value that may damage the coupler and a damaging run-out is avoided.

To avoid a train run-in at a track sag, the lead locomotive consist should have an acceleration that is some fraction (preferably near unity) of the maximum natural acceleration of the train. This can be accomplished by modifying the original planned trip profile by decreasing train speed beforehand such that the needed acceleration as the train traverses the sag can be achieved without exceeding the speed set forth in the original trip plan. If the terrain identification process of the present invention is executed prior to the train trip, then the speed reduction and increase at it approaches the sag can be included in the original trip plan.

One embodiment of the present invention comprises an operator display and/or annunciator for providing an indication related to train handling issues as determined according to the techniques of the present invention. For a crest terrain feature, the display can include, for example, indications or annunciations related to one or more of crest severity, delta effective grade, peak coupler force, location of the peak force, segment (length) of the train on the up hill/down hill side of the crest, location/car number at the peak of the crest and weight of the train on either side of the crest. Other crest-related parameters can also be indicated and/or annunciated. For example, peak force can be determined from correlation value and train weight. The location of peak will always be at apex, whereas all other locations are known. The information can be displayed in graphical form (for example, a plot of elevation profile and train location), in numerical form (for example, a peak force of 100 klb at the $10^{th}$ car), in text form (for example, a high or medium reading) or any combination thereof. Similar indicia can be provided for sag, super-elevation and curve track features.

Figure 8:
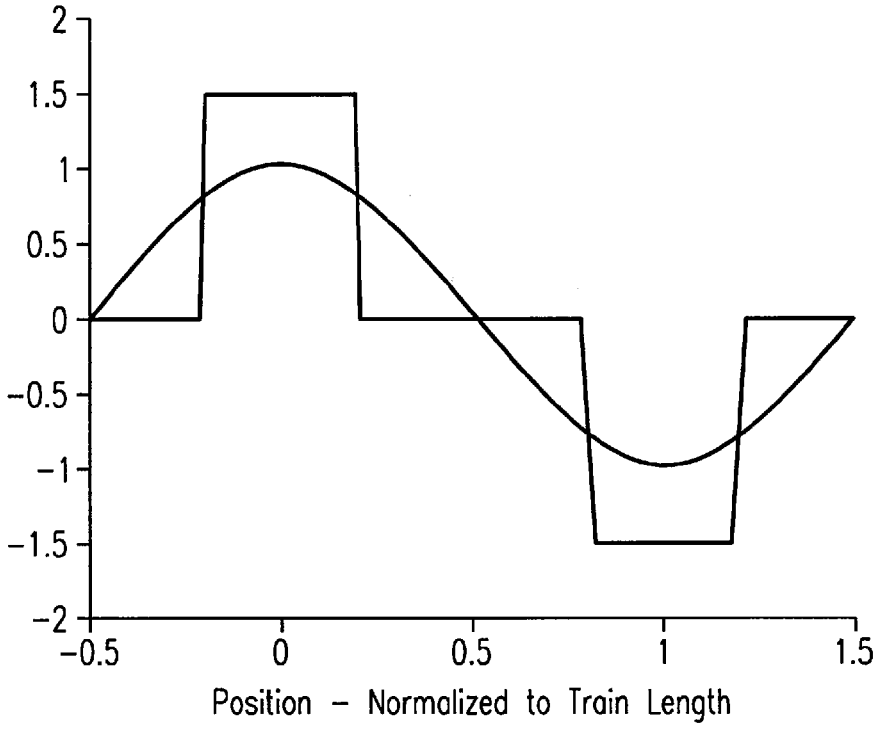

In one embodiment, the track profile is correlated to multiple patterns, allowing for multi-dimensional classification, e.g., both curvature and grade (or any number of other track parameters and/or pattern combinations) in the identification of one feature. Preferably, the peak correlation values for each candidate pattern are normalized for comparison from train to train. For the 2-dimensional case, the terrain can be identified by quadrant as shown in FIG. 8. For example, Q1 could indicate a crest with significant curvature while Q2 indicates a crest with no curvature. The thresholds now take the form of some geometric region in the n-dimensional space, such as, for example, concentric circles or a square centered on the origin (zero correlation to both patterns). A particular multi-dimensional correlation of interest is one involving curvature and super-elevation as described below.

Curves are another terrain feature of interest that can present train handling problems and therefore can be analyzed according to the teachings of the present invention. As is known, track curves are sometimes constructed with super-elevation that allows higher train speeds in the curve. At low speeds, curved track segments, particularly curves with a high degree of super-elevation, present a risk referred to as stringlining in the tension case and buckling or jackknifing in the compression case. When the train navigates a high curvature feature, large coupler angles are formed between cars, with the force depending on the curve length and curvature. If the resulting lateral forces are substantially larger than the vertical forces (due to the railcar weight), the cars may derail.

To identify the train handling risks in these situations, a two-dimensional correlation is performed with curvature and super-elevation patterns that match a typical curve with typical super-elevation. The risk increases proportionally with the distance from zero correlation (a tangent track) and inversely with train speed. This multi-dimensional correlation can be represented as follows:

$$stringliningRisk(x) = \frac{\sqrt{correlation^2_{curve}(x) + correlation^2_{superelev}(x)}}{\text{train_speed}(x)}$$

As described above for the crest/sag features, the curvature/super-elevation patterns can be modified based on train characteristics, such as individual car weight, mass distribution and train length, etc. The risk value from the equation above can be used to limit tractive effort when an automatic control system is present or notify the operator via a graphical or textual format of the current stringlining risk level or a recommended TE limit.

For a curve feature the displayed or provided information can include curvature of the curve, curve length, super-elevation, peak L/V ratio, and location of these as a function of current track location and location within the train. The information can also include optimum speed to minimize or limit lateral forces and optimum speed for curves at forward track positions. The information provided includes the entire train or sub-trains (for example, for distributed power operation).

In an alternative embodiment, an effective curvature can be found based on the train speed and super-elevation to determine a base lateral/vertical ratio, with the additional lateral forces generated by the consist forces added to the base. In this case only a one-dimensional correlation is required.

Although many of the concepts of the invention embodiments are described with reference to a single train as it traverses a crest in the rail network, the teachings also apply to sub-trains and train segments (including arbitrary train segments and individual railcars), and the sub-trains defined by distributed power locomotives in a distributed power (DP) train.

Modifications to the terrain identification and crest/sag control can be made to further contain the dynamics of a DP train. When one or more remote (non-lead) consists are present, the net effect separates the train mass into two or more parts, each part coupled to one consist. This division can be represented by a ratio of total mass (or length, if weight distribution is unknown) to consist power, or dynamically according to a calculated node at each instant in time, where the node defines the end-point of the train segments. When the train is effectively segregated into sub-trains, the previously described terrain identification and control processes can be employed to identify significant terrain for each of the sub-trains. This additional information is useful to determine the best train control strategy for each consist (relative to the trip plan) when automatic train control controls the train. Alternatively, in a manually operated train, the control information provides operator notification of the train condition or advises a train control strategy. For instance, if additional power is desired and the train mass coupled to the remote consist is experiencing a crest, the control will give preference to increasing the notch of the lead consist. Similarly for sags relative to decreasing power. Also, multiple flags, annunciations and displayed information for the different sub-trains that each locomotive consist is bearing to allow for independent control of each consist.

Although certain techniques and mathematical equations are set forth herein for determining, predicting and/or inferring parameters related to the condition (including its slack condition) of the train and train segments, the embodiments of the inventions are not limited to the disclosed techniques and equations, but instead encompass other techniques and equations known to those skilled in the art.

One skilled in the art recognizes that simplifications and reductions may be possible in representing train parameters, such as grade, drag, etc. and in implementing the equations set forth herein. Thus the embodiments of the invention are not limited to the disclosed techniques, but also encompass simplifications and reductions for the data parameters and equations.

Figure 9:
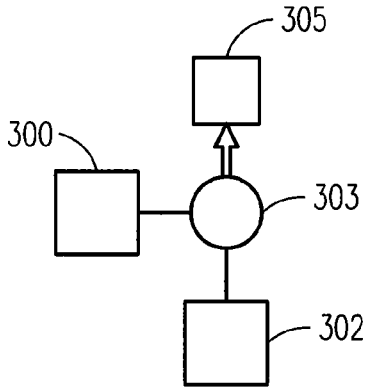
FIG. 9 illustrates a simplified block diagram of elements according to the teachings of embodiments of the invention.

FIG. 9 illustrates a simplified block diagram of elements according to the teachings of embodiments of the invention. As illustrated, a first element 300 is provided which is configured to produce a terrain profile that represents a parameter of the railway system or a portion thereof. A second element 302 is configured to produce a representation of the vehicle or a portion thereof. A third element 303 is provided to use the terrain profile and representation to derive the control parameter, or indication or indicia, 305 for the vehicle or the portion thereof. This use may be to combine the terrain profile and representation such as by multiplication, addition, or some other mathematical function. A display may also be provided so that a user is able to view any one of the control parameter, the representation, and/or the terrain profile.

The embodiments of the present invention contemplate multiple options for the host processor computing the train condition information, including processing the algorithm on the locomotive of the train within wayside equipment, off-board (in a dispatch-centric model) or at another location on the rail network. Execution can be prescheduled, processed in real time or driven by a designated event such as a change in-train or locomotive operating parameters, that is operating parameters related to either the train of interest or other trains that may be intercepted by the train of interest.

The methods and apparatus of the inventions provide train condition information for use in controlling the train. Since the techniques of the inventions are scalable, they can provide an immediate rail network benefit even if not implemented throughout the network. Local tradeoffs can also be considered without the necessity of considering the entire network.

This written description uses examples to disclose the various embodiments of the invention, including the best mode, and also to enable any person skilled in the art to make and use the invention. The patentable scope of the invention is defined by the claims and may include other examples that occur to those skilled in the art. Such other examples are intended to be within the scope of the claims if they have structural elements that do not differ from the literal language of the claims or if they include equivalent structural elements with insubstantial differences from the literal languages of the claims.

What is claimed is:

1. A method comprising:

accessing an actual terrain profile representing at least one of actual grades or actual curvatures of a track over which a rail vehicle is traveling or will travel;

obtaining a profile pattern of interest representative of at least one of a crest of interest, a sag of interest, or a curve of interest;

determining one or more feature correlation parameters based on a comparison of the profile pattern of interest and the actual terrain profile, the one or more feature correlation parameters representative of a presence of the profile pattern of interest in the actual terrain profile;

deriving a control parameter for the rail vehicle as a function of the one or more feature correlation parameters; and controlling at least one of tractive effort or braking effort of the rail vehicle based on the control parameter.

2. The method of claim 1 wherein deriving the control parameter further comprises comparing vehicle characteristic information with the one or more feature correlation parameters to provide an indication of one or more vehicle handling characteristics associated with traveling over the profile pattern of interest.

3. The method of claim 1 wherein the actual terrain profile includes at least one of values of slopes of the actual grades of the track or values of the actual curves of the track.

4. The method of claim 1 wherein determining the one or more feature correlation parameters includes comparing the profile pattern of interest to the actual terrain profile over a portion of an entire length of the rail vehicle.

5. The method of claim 1 wherein the rail vehicle comprises a distributed power train having a lead locomotive consist, a non-lead locomotive consist, a first railcar group between the lead locomotive consist and the non-lead locomotive consist, and a second railcar group trailing the non-lead locomotive consist, and wherein determining the one or more feature correlation parameters includes comparing the profile pattern of interest and the actual terrain profile over a first profile segment for the lead locomotive consist and the first railcar group and over a second profile segment for the non-lead locomotive consist and the second railcar group.

6. The method of claim 1 wherein the actual terrain profile comprises multi-dimensional profiles.

7. The method of claim 1 wherein the actual terrain profile comprises one or more of a crest, a sag, a terrain gradient, a track curve, or a track super-elevation.

8. The method of claim 2 wherein the vehicle characteristic information comprises a number of railcars of the rail vehicle, a length of one or more of the railcars of the vehicle, a weight of one or more of the railcars of the vehicle, a coupler type, a train type, or a nonuniform weight distribution of the rail vehicle.

9. The method of claim 2 wherein the vehicle characteristic information has a normalized value, and wherein the vehicle characteristic information includes one or more values above or below the normalized value, and wherein determining the one or more feature correlation parameters comprises multiplying the vehicle characteristic information by the actual terrain profile.

10. The method of claim 1 wherein the one or more feature correlation parameters represent a correlation between the profile pattern of interest and one or more of the actual grades or actual curves.

11. The method of claim 10 wherein determining the one or more feature correlation parameters comprises integrating a product of the profile pattern of interest and the actual terrain profile over two or more lengths of the rail vehicle, wherein the values of the one or more feature correlation parameters are a function of a location on the track.

12. The method of claim 2 wherein the vehicle characteristic information comprises a uniformly distributed characteristic information over two or more lengths of the rail vehicle.

13. The method of claim 12 wherein the vehicle characteristic information comprises vehicle weight.

14. The method of claim 1 wherein controlling the at least one of tractive effort or braking effort further comprises at least one of limiting acceleration of the rail vehicle responsive to the one or more of the feature correlation parameters that represent an indication of a terrain crest, accelerating the rail vehicle responsive to the one or more of the feature correlation parameters that represent an indication of a terrain sag, or limiting application of the tractive effort responsive to the one or more of the feature correlation parameters that represent an indication of a track curve.

15. The method of claim 1 wherein controlling the at least one of tractive effort or braking effort includes changing speed of the rail vehicle based on the one or more feature correlation parameters.

16. The method of claim 1 wherein controlling the at least one of tractive effort or braking effort includes limiting the application of the tractive effort responsive to one or more of a degree of curvature of the track curve, a degree of super elevation of the track curve, a length of railcars included in the rail vehicle, a weight of the railcars included in the vehicle, or a speed of the rail vehicle.

17. The method of claim 1 wherein controlling the at least one of tractive effort or braking effort includes limiting acceleration of the rail vehicle responsive to one or more of a slope of the crest or vehicle characteristic information.

18. The method of claim 1 wherein deriving the control parameter includes providing an indication of the one or more feature correlation parameters associated with a track segment as the rail vehicle traverses the track segment, and further comprising displaying the indication.

19. The method of claim 18 wherein displaying the indication includes displaying at least one of a time parameter indicating when the track segment will be encountered by the rail vehicle or a distance parameter indicating a distance between the rail vehicle and the track segment.

20. The method of claim 18 wherein the track segment comprises at least one of a crest or a sag in the track and wherein the indication further comprises a severity of the one or more feature correlation parameters associated with the track segment, a slope of a grade change associated with the track segment, a location of the rail vehicle relative to the track segment, one or more coupler forces for different segments of the rail vehicle as the rail vehicle traverses the track segment, a peak coupler force as the rail vehicle traverses the track segment, or a location of the peak coupler force on the rail vehicle.

21. The method of claim 18 wherein the track segment comprises a track curve, and wherein the indication associated with the track segment further comprises at least one of a tractive effort limit, a peak lateral-to-vertical force ratio, a lateral-to-vertical force ratio for one or more segments of the rail vehicle, or a speed to reduce the lateral-to-vertical force ratio to a predetermined value.

22. The method of claim 18 wherein the indication associated with the track segment comprises a visual display providing the indication in one of more of a graphical, numerical, or textual form.

23. The method of claim 1 wherein determining the one or more feature correlation parameters further comprises providing an effective grade of the track responsive to the actual terrain profile and vehicle characteristic information of the rail vehicle.

24. The method of claim 23 wherein the effective grade is based on the actual terrain profile and a weight distribution of the rail vehicle.

25. The method of claim 2 wherein the vehicle characteristic information comprises a non-uniformly distributed characteristic information over the length of the vehicle.

26. A method comprising:

receiving an actual terrain profile of a route to be traversed by a vehicle, the terrain profile including actual characteristics of the route locations along the route, the actual characteristics of the route representative of at least one of a change in actual slope or actual curvature of the route at the locations;

obtaining a profile pattern of interest representative of one or more slopes or curvatures of geographic features of interest;

determining a feature correlation parameter representative of an amount of match between the actual terrain profile and the profile pattern of interest at one or more of the locations along the route, the feature correlation parameter based on a combination of the profile pattern of interest and the actual terrain profile; and generating an output signal configured to control movement of the vehicle, the output signal based on the feature correlation parameter.

27. The method of claim 26, wherein determining the feature correlation parameter includes calculating a product of the actual terrain profile and the profile pattern of interest.

28. The method of claim 26, wherein determining the feature correlation parameter includes combining vehicle characteristic information with the actual terrain profile and the profile pattern of interest, the vehicle characteristic information representative of at least one of weight of the vehicle, weight distribution of the vehicle, length of the vehicle, or coupling forces between connected cars of the vehicle.

29. The method of claim 26, wherein the geographic features of interest represented by the profile pattern of interest include one or more crests of interest, sags of interest, or curves of interest.

30. The method of claim 26, wherein determining the feature correlation parameter includes assigning a magnitude value to the feature correlation parameter that is representative of the amount of match between the actual terrain profile and the profile pattern of interest, the magnitude value being larger when the amount of match between the actual terrain profile and the profile pattern of interest.

31. The method of claim 26, wherein the output signal is configured to be used to control at least one of tractive effort or braking effort of the vehicle as the vehicle traverses the route.

32. The method of claim 26, further comprising identifying at least one of a crest or a sag in the route based on the feature correlation parameter, the crest representative of a peak in the route that exceeds a first designated threshold, the sag representative of a dip in the route that exceeds a second designated threshold.

33. The method of claim 32, wherein a value of the feature correlation parameter is proportional to a height of the crest or a depth of the sag.

34. The method of claim 32, wherein the vehicle is an elongated vehicle comprising a plurality of interconnected cars, and the feature correlation parameter is configured to be used to control movement of the vehicle such that the vehicle accelerates or slows down as the vehicle crosses the crest or the sag.

35. The method of claim 26, wherein the output signal is configured to control the movement of the vehicle such that the vehicle accelerates or slows down based on where the crest or the sag is located along a length of the vehicle as the vehicle crosses the crest or the sag.

* * * * *